US007445016B1

(12) United States Patent
Ortiz

(10) Patent No.: US 7,445,016 B1
(45) Date of Patent: Nov. 4, 2008

(54) SHOCK-ABSORBING CANE

(76) Inventor: Ralph O. Ortiz, 100 Beekman St. #8D, New York, NY (US) 10038

( * ) Notice: Subject to any disclaimer, the term of this patent is extended or adjusted under 35 U.S.C. 154(b) by 107 days.

(21) Appl. No.: 11/598,598

(22) Filed: Nov. 13, 2006

(51) Int. Cl.
*A45B 7/00* (2006.01)
*A45B 9/02* (2006.01)

(52) U.S. Cl. ..... 135/65; 135/76

(58) Field of Classification Search ..... 135/65, 135/72, 76; 280/819, 821
See application file for complete search history.

(56) References Cited

U.S. PATENT DOCUMENTS 2,802,479 A 8/1957 Hickman
4,061,347 A * 12/1977 Stern et al. ..... 280/821
4,958,651 A 9/1990 Najm
5,699,819 A 12/1997 Simmons
5,720,474 A 2/1998 Sugiyama
2004/0250845 A1 12/2004 Rudin et al.

* cited by examiner

*Primary Examiner*—David R Dunn
*Assistant Examiner*—Danielle Jackson
(74) *Attorney, Agent, or Firm*—Richard L. Miller

(57) ABSTRACT

A shock absorbing cane, including a shaft and a handle, the shaft having a self propelling and repositioning forward motion when compressed handle is lifted by user. The shaft extends from the handle and the handle is shock-absorbing for absorbing impact when the shaft strikes against an unyielding surface. The handle includes a fixed portion, a movable portion, and a dampening assembly. The fixed portion is affixed to the shaft and the movable portion is movably mounted to the fixed portion. The dampening assembly includes a tension spring disposed in the fixed portion of the handle, with one leg thereof extending into the shaft to preload the tension spring by biasing against the shaft, and with the other leg thereof extending via a rod into and affixed to the movable portion of the handle, thereby allowing the movable portion of the handle to resiliently move relative to the shaft and absorb impact when the shaft strikes against the unyielding surface.

7 Claims, 2 Drawing Sheets

SHOCK-ABSORBING CANE

BACKGROUND OF THE INVENTION

1. Field of the Invention

The embodiments of the present invention relates to a cane, and more particularly, the embodiments of the present invention relate to a shock-absorbing cane.

2. Description of the Prior Art

Numerous innovations for canes have been provided in the prior art that will be described. Even though these innovations may be suitable for the specific individual purposes to which they address, however, they differ from the embodiments of the present invention.

A FIRST EXAMPLE, U.S. Pat. No. 2,802,479 published/issued on Aug. 13, 1957 to Hickman teaches a walking cane, including an outer casing support, a handle member, apparatus for slidably mounting a portion of the handle in the upper end of the casing, spring apparatus mounted in the casing adjacent the handle member, a lock bolt secured to the handle portion, longitudinal slot apparatus formed in the casing adapted to slidably receive the lock bolt, an offset slot including an upper short transverse portion, a short longitudinal portion and a lower transverse portion connecting with the longitudinal slot apparatus for receiving the lock bolt to lock the handle in a semi-rigid position on the casing.

A SECOND EXAMPLE, U.S. Pat. No. 4,958,651, issued on Sep. 25, 1990 to Najm teaches a device for a mobility cane, which assists in the cushioning of impact and the avoidance of obstacles. The impact cushioning component can be adapted at either end of the cane or built into any portion along the length of the cane.

A THIRD EXAMPLE, U.S. Pat. No. 5,699,819 issued on Dec. 23, 1997 to Simmons teaches a reduced impact cane for absorbing impact of a cane striking against an unyielding surface. The device includes a cane having a end, a spring connector, a connecting sleeve disposed around the cane end and spring connector, a collar disposed around the lower end of the spring connector, a rubber tip disposed around the collar, and a spring interposed between the lower end of the spring connector and the rubber tip.

A FOURTH EXAMPLE, U.S. Pat. No. 5,720,474 issued on Feb. 24, 1998 to Sugiyama teaches a shock absorbing mechanism for displacement for a stick, an artificial leg, etc. such as a walking stick, a crutch, a stick for sports, an artificial leg, a walking tool for a patient, a chair, or a protecting bed, in which elastic materials having several different moduli of elasticity are built in a small space of a compression coil spring, and accomplish an elastic sticky force like a human muscle, which is light.

A FIFTH EXAMPLE, U.S. Pat. No. 200/0250845 A1 published on Dec. 16, 2004 to Rudin et al. teaches a walking stick with a flexure spring to store energy from compression during the user's step, and release the energy to aid in propelling the user forward, thereby reducing fatigue and enabling longer and faster walks.

It is apparent that numerous innovations for canes have been provided in the prior art that are adapted to be used. Furthermore, even though these innovations may be suitable for the specific individual purposes to which they address, however, they would not be suitable for the purposes of the embodiments of the present invention as heretofore described.

SUMMARY OF THE INVENTION

According, it is an object of the present invention to provide a shock-absorbing cane that avoids the disadvantages of the prior art.

Briefly stated, another object of the present invention is to provide a shock absorbing cane, including a shaft and a handle. An additional object of the present invention is to provide a cane, having a shaft that self propels forward and repositions itself, when user lifts compressed handle in a simple and certain manner. Shaft having a controlled forward momentum that moves in unison with every stride or step user takes. The shaft extends from the handle and the handle is shock-absorbing for absorbing impact when the shaft strikes against an unyielding surface. The handle includes a fixed portion, a movable portion, and a dampening assembly. The fixed portion is affixed to the shaft and the movable portion is movably mounted to the fixed portion. The dampening assembly includes a tension spring disposed in the fixed portion of the handle, with one leg thereof extending into the shaft to preload the tension spring by biasing against the shaft, and with the other leg thereof extending via a rod into and affixed to the movable portion of the handle, thereby allowing the movable portion of the handle to resiliently move relative to the shaft and absorb impact when the shaft strikes against the unyielding surface.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
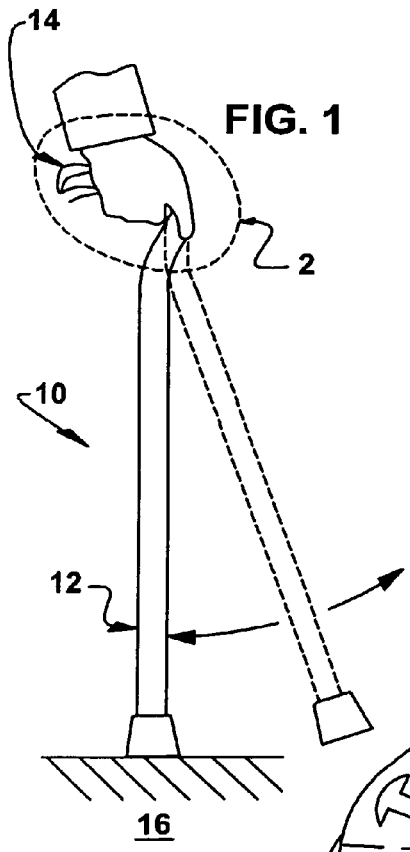
FIG. 1 is a diagrammatic side elevational view of the shock-absorbing cane of the embodiments of the present invention in use.

10 shock absorbing cane of embodiments of present invention
12 shaft
14 handle for absorbing impact when shaft 12 strikes against unyielding surface 16
16 unyielding surface
18 fixed portion of handle 14
20 movable portion of handle 14
22 body of movable portion 20 of handle 14
26 elbow of fixed portion 18 of handle 14
28 first end of elbow 26 of fixed portion 18 of handle 14
30 second end of elbow 26 of fixed portion 18 of handle 14

31 transverse throughbore through elbow 26 of fixed portion 18 of handle 14
32 cushioning bushing of fixed portion 18 of handle 14
34 dampening assembly of handle 14
36 tension spring of dampening assembly 34 of handle 14
38 one leg of tension spring 36 of dampening assembly 34 of handle 14
40 other leg of tension spring 36 of dampening assembly 34 of handle 14
42 rivet of dampening assembly 34 of handle 14
44 eye of tension spring 36 of dampening assembly 34 of handle 14
46 biasing stop of dampening assembly 34 of handle 14
48 rod of dampening assembly 34 of handle 14
49 end of body 22 of movable portion 20 of handle 14
50 screw of dampening assembly 34 of handle 14

DETAILED DESCRIPTION OF THE PREFERRED EMBODIMENT

Figure 2:
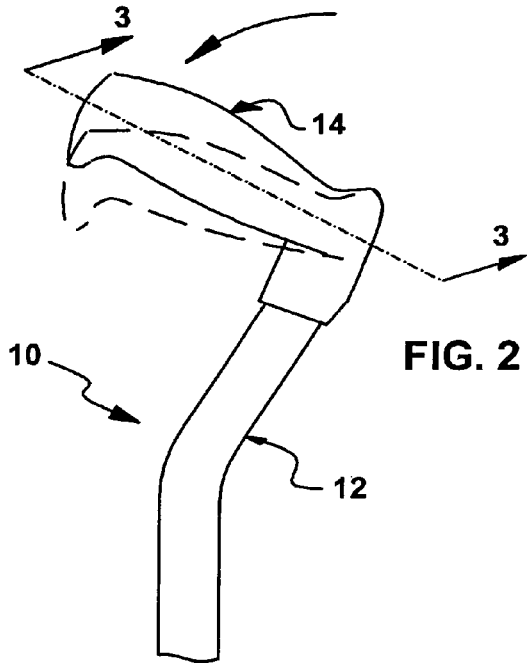
FIG. 2 is an enlarged diagrammatic side elevational view of the area generally enclosed by the dotted curve identified by ARROW 2 in FIG. 1 of the shock-absorbing handle of the shock-absorbing cane of the embodiments of the present invention.

Referring now to the figures, in which like numerals indicate like parts, and particularly to FIGS. 1 and 2, which are, respectively, a diagrammatic side elevational view of the shock-absorbing cane of the embodiments of the present invention in use, and an enlarged diagrammatic side elevational view of the area generally enclosed by the dotted curve identified by ARROW 2 in FIG. 1 of the shock-absorbing handle of the shock-absorbing cane of the embodiments of the present invention, the shock absorbing cane of the embodiments of the present invention is shown generally at 10.

The shock-absorbing cane 10 comprises a shaft 12 and a handle 14. The shaft 12 extends from the handle 14. The handle 14 is shock-absorbing for absorbing impact when the shaft 12 strikes against an unyielding surface 16.

Figure 3:
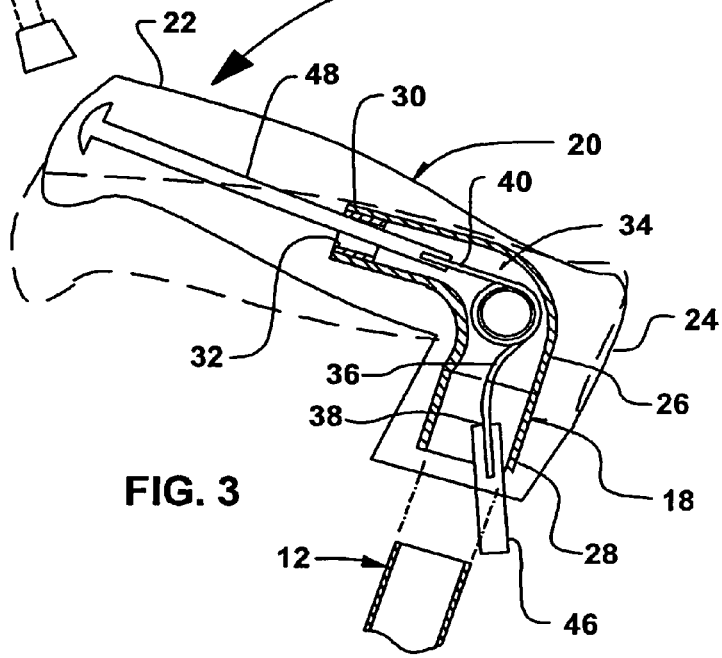
FIG. 3 is an enlarged diagrammatic cross sectional view taken along LINE 3-3 in FIG. 2 of the shock-absorbing handle of the shock-absorbing cane of the embodiments of the present invention.
Figure 4:
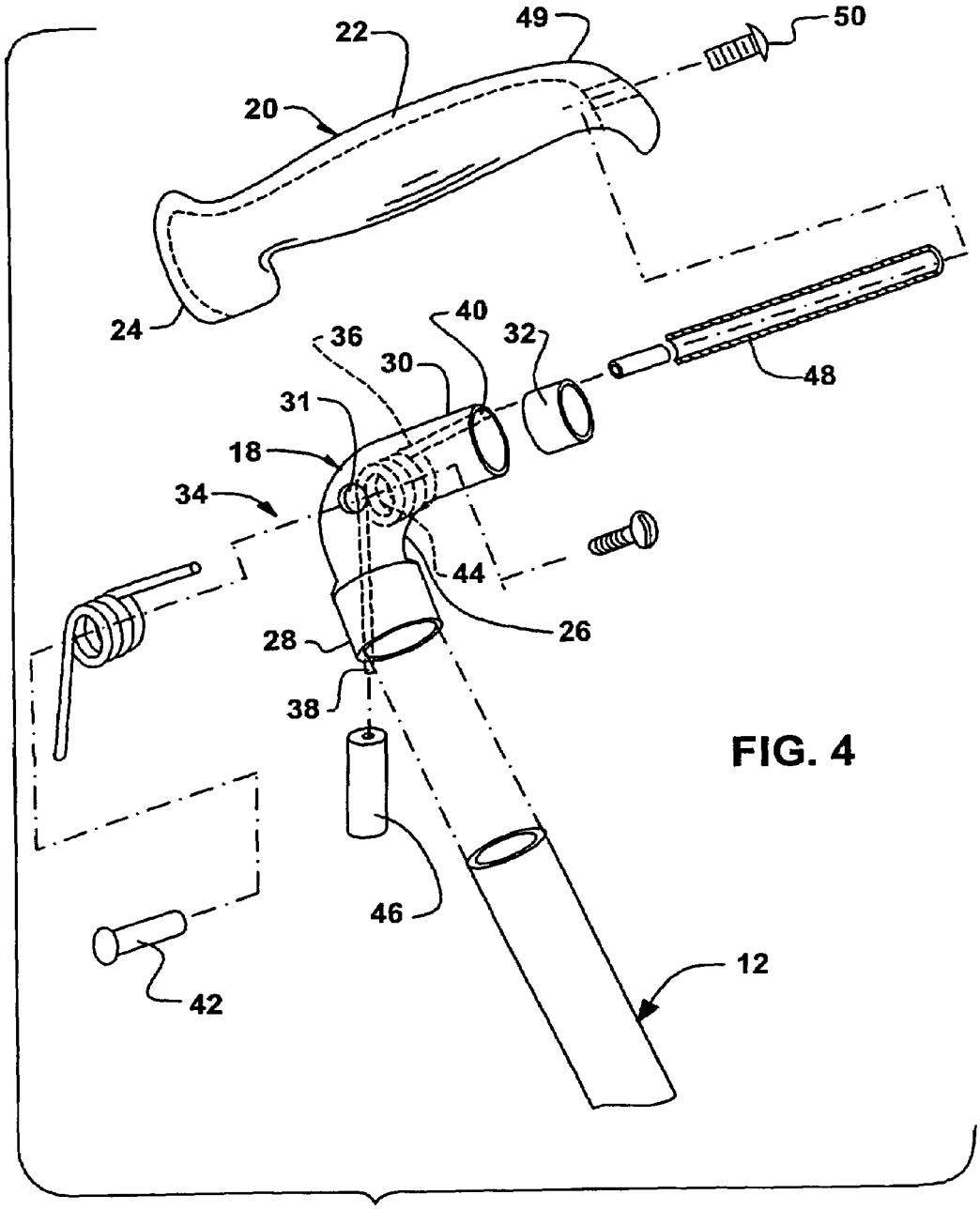
FIG. 4 is an exploded diagrammatic perspective view of the shock-absorbing handle of the shock-absorbing cane of the embodiments of the present invention.

The configuration of the handle 14 can best can be seen in FIGS. 3 and 4, which are, respectively, an enlarged diagrammatic cross sectional view taken along LINE 3-3 in FIG. 2 of the shock-absorbing handle of the shock-absorbing cane of the embodiments of the present invention, and an exploded diagrammatic perspective view of the shock-absorbing handle of the shock-absorbing cane of the embodiments of the present invention, and as such, will be discussed with reference thereto.

The handle 14 comprises a fixed portion 18 and a movable portion 20. The fixed portion 18 of the handle 14 is affixed to the shaft 12. The movable portion 20 of the handle 14 is movably mounted to the fixed portion 18 of the handle 14.

The movable portion 20 of the handle 14 is generally L-shaped, and as such, has a body 22 and a head 24. The head 24 of the movable portion 20 of the handle 14 extends substantially normally from the body 22 of the movable portion 20 of the handle 14.

The fixed portion 18 of the handle 14 comprises an elbow 26. The elbow 26 of the fixed portion 18 of the handle 14 is hollow, and has a first end 28, a second end 30, and a transverse throughbore 31 therebetween.

The movable portion 20 of the handle 14 movably receives the elbow 26 of the fixed portion 18 of the handle 14, with the first end 28 of the elbow 26 of the fixed portion 18 of the handle 14 extending freely in the head 24 of the movable portion 20 of the handle 14 and fixedly receiving the shaft 12, and with the second end 30 of the elbow 26 of the fixed portion 18 of the handle 14 extending freely in the body 22 of the movable portion 20 of the handle 14, so as to allow the movable portion 20 of the handle 14 to move relative to the elbow 26 of the fixed portion 18 of the handle 14.

The fixed portion 18 of the handle 14 further comprises a cushioning bushing 32. The cushioning bushing 32 of the fixed portion 18 of the handle 14 lines the second end 30 of the elbow 26 of the fixed portion 18 of the handle 14.

The handle 14 further comprises a dampening assembly 34. The dampening assembly 34 of the handle 14 comprises a tension spring 36. The tension spring 36 of the dampening assembly 34 of the handle 14 is disposed in the elbow 26 of the fixed portion 18 of the handle 14, with one leg 38 of the tension spring 36 of the dampening assembly 34 of the handle 14 extending through the first end 28 of the below 26 of the fixed portion 18 of the handle 14, with the other leg 40 of the tension spring 36 of the dampening assembly 34 of the handle 14 extending into the second end 30 of the elbow 26 of the fixed portion 18 of the handle 14, and with the tension spring 36 of the dampening assembly 34 of the handle 14 being maintained in the below 26 of the fixed portion 18 of the handle 14 by a rivet 42 extending through the throughbore 26 of the fixed portion 18 of the handle 14 and through the eye 44 of the tension spring 36 of the dampening assembly 34 of the handle 14.

The dampening assembly 34 of the handle 14 further comprises a biasing stop 46. The biasing stop 46 of the dampening assembly 34 of the handle 14 extends from the one leg 38 of the tension spring 36 of the dampening assembly 34 of the handle 14, and when inserted into the shaft 12, preloads the tension spring 36 of the dampening assembly 34 of the handle 14 by biasing against the shaft 12. The preloaded tension of the biasing stop 46 of the dampening assembly 34 of handle 14 when biasing against shaft 12 and the preloaded tension of leg 38 of tension spring 36 of dampening assembly 34 of the handle 14 is increased when handle 14 is fully compressed, causing shaft 12 to self propel forward and reposition itself when fully compressed handle 14 is lifted by user in a simple and certain manner.

The dampening assembly 34 of the handle 14 further comprises a rod 48. The rod 48 of the dampening assembly 34 of the handle 14 extends from the other leg 40 of the tension spring 36 of the dampening assembly 34 of the handle 14, through the second end 30 of the elbow 26 of the fixed portion 18 of the handle 14, against the cushioning bushing 32 of the fixed portion 18 of the handle 14, and into the body 22 of the movable portion 20 of the handle 14 where it is affixed to an end 49 thereof by a screw 50, and thereby allowing the movable portion 20 of the handle 14 to resiliently move relative to the shaft 12 and absorb impact when the shaft 12 strikes against the unyielding surface 16.

It will be understood that each of the elements described above, or two or more together, may also find a useful application in other types of constructions differing from the types described above.

While the invention has been illustrated and described as embodied in a shock-absorbing cane, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspect of this invention.

The invention claimed is:

1. A shock absorbing cane, comprising:

a) a shaft; and b) a handle;

wherein said shaft extends from said handle;

wherein said handle is shock-absorbing for absorbing impact when said shaft strikes against an unyielding surface;

wherein said handle comprises a fixed portion;

wherein said handle comprises a movable portion;

wherein said fixed portion of said handle is affixed to said shaft;

wherein said movable portion of said handle is movably mounted to said fixed portion of said handle;

wherein said movable portion of said handle is generally L-shaped;

wherein said movable portion of said handle has a body;

wherein said movable portion of said handle has a head;

wherein said head of said movable portion of said handle extends substantially normally from said body of said movable portion of said handle;

wherein said fixed portion of said handle comprises an elbow;

wherein said elbow of said fixed portion of said handle is hollow;

wherein said elbow of said fixed portion of said handle has a first end;

wherein said elbow of said fixed portion of said handle has a second end; and wherein said elbow of said fixed portion of said handle has a transverse throughbore between said first end thereof and said second end thereof.

2. The cane of claim 1, wherein said movable portion of said handle movable receives said elbow of said fixed portion of said handle;

wherein said first end of said elbow of said fixed portion of said handle extends freely in said head of said movable portion of said handle;

wherein said first end of said elbow of said fixed portion of said handle fixed receives said shaft; and wherein said second end of said elbow of said fixed portion of said handle extends freely in said body of said movable portion of said handle.

3. The cane of claim 1, wherein said fixed portion of said handle comprises a cushioning bushing; and wherein said cushioning bushing of said fixed portion of said handle lines said second end of said elbow of said fixed portion of said handle.

4. The cane of claim 3, wherein said handle comprises a dampening assembly.

5. The cane of claim 4, wherein said dampening assembly of said handle comprises a tension spring;

wherein said tension spring of said dampening assembly of said handle is disposed in said elbow of said fixed portion of said handle;

wherein one leg of said tension spring of said dampening assembly of said handle extends through said first end of said elbow of said fixed portion of said handle;

wherein the other leg of said spring of said dampening assembly of said handle extends into said second end of said elbow of said fixed portion of said handle; and wherein said tension spring of said dampening assembly of said handle is maintained in said elbow of said fixed portion of said handle by a rivet extending through said throughbore in said elbow of said fixed portion of said handle and through the eye of said tension spring of said dampening assembly of said handle.

6. The cane of claim 5, wherein said dampening assembly of said handle comprises a biasing stop; and wherein said biasing stop of said dampening assembly of said handle extends from said one leg of said tension spring of said dampening assembly of said handle, and when inserted into said shaft, preloads said tension spring of said dampening assembly of said handle by biasing against said shaft.

7. The cane of claim 5, wherein said dampening assembly of said handle comprises a rod;

wherein said rod of said dampening assembly of said handle extends from said other leg of said tension spring of said dampening assembly of said handle;

wherein said rod of said dampening assembly of said handle extends through said second end of said elbow of said fixed portion of said handle;

wherein said rod of said dampening assembly of said handle extends against said cushioning bushing of said fixed portion of said handle; and wherein said rod of said dampening assembly of said handle extends into said body of said movable portion of said handle where it is affixed to an end thereof by a screw.

* * * * *